US006095097A

United States Patent [19]

Gibson et al.

[11] Patent Number: 6,095,097

[45] Date of Patent: Aug. 1, 2000

[54] ADJUSTABLE LOUVER SYSTEM FOR RADIANT HEAT TRANSFER CONTROL IN A DIRECT-FIRED HEATER

[75] Inventors: William C. Gibson; James T. Eischen, both of Tulsa, Okla.

[73] Assignee: Petro-Chem Development Co., Inc., Tulsa, Okla.

[21] Appl. No.: 09/378,850

[22] Filed: Aug. 23, 1999

[51] Int. Cl.[7] ..... F22B 23/06; F22B 37/10

[52] U.S. Cl. ..... 122/367.1; 165/96; 165/DIG. 132

[58] Field of Search ..... 122/44.2, 155.2, 122/503, 367.1, 367.2, 367.3; 432/175; 110/261, 262, 263, 264, 265; 165/96, DIG. 132, 904

[56] References Cited

U.S. PATENT DOCUMENTS 4,617,870 10/1986 Hirano et al. ..... 110/323

5,365,888 11/1994 Aronov ..... 122/367.1

*Primary Examiner*—Denise L. Ferensic

*Assistant Examiner*—Jiping Lu

*Attorney, Agent, or Firm*—Head, Johnson & Kachigian

[57] ABSTRACT

An adjustable louver system for controlling the direct thermal radiation reaching fluid tubes in a direct-fired heater. An angular position of louver blades of the louver system is adjusted by rotating first and second axles attached to the louver blades. The louver blades may be positioned manually or by an electric or pneumatic motor. A hand crank or knob located outside the heater manually turns the louver blades. The motor, which is also located outside the heater, is controllable by a temperature actuator. In some embodiments, the louver blades have pivot pins which fit into slots of a connecting plate. Rotation of one of the louver blade causes the connecting plate to rotate all of the louver blades simultaneously. In some embodiments, the louver blades are vertically positioned and the louver axles fit into holes in upper and lower guide plates. In other embodiments, the louvers are horizontally disposed and the louver axles fit into openings in the heater walls.

16 Claims, 6 Drawing Sheets

ADJUSTABLE LOUVER SYSTEM FOR RADIANT HEAT TRANSFER CONTROL IN A DIRECT-FIRED HEATER

BACKGROUND OF THE INVENTION

1. Field of the Invention.

The invention relates to adjustable radiant heat barriers in heaters.

2. Description of the Related Art.

When a body is placed in an enclosure whose walls are at a temperature above that of the body, the temperature of the body will increase even if the enclosure is evacuated. The process by which heat is transferred from an enclosure by virtue the temperature of the enclosure, without the aid of any intervening medium, is called thermal radiation. The emission of thermal radiation is governed by the temperature of the emitting enclosure. The range of wavelengths of thermal radiation is approximately 0.1 microns to 100 microns.

Direct-fired heaters with fluid tubes on the outside walls of the heater are commonly used in various industrial applications. The fluid in the fluid tubes is often water, hydrocarbon fluid, or some other type of heat transfer fluid. Direct-fired heaters have an interior combustion chamber in which fuel and oxygen combine in the presence of an ignition source to form a flame. The flame, the flue gases and other products of combustion produce electromagnetic radiation which heats the fluid in the fluid tubes. Although heat conduction and convection also occur in the combustion chamber, the primary mode of heat transfer from the flame to the fluid tubes is usually radiative heat transfer.

When radiant heat from the flame and the combustion gases reaches the outer surface of the fluid tubes, this outer surface absorbs, transmits and reflects the radiant heat. For opaque surfaces such as fluid tubes, the amount of radiant heat directly transmitted by the fluid tube outer surface is not significant. The heat absorbed by this outer surface is then re-emitted or transported away from the outer surface to the fluid inside the tubes by a combination of conduction and convection. The heat conducted away from the outer surface of the fluid tubes passes through the solid material of the fluid tubes to the inner surfaces of the tubes. At this inner surface, fluid flowing through the fluid tubes absorbs the heat and transports it downstream, eventually exiting the portion of the fluid tubes within the heater.

In most applications, the fluid tubes are connected to a piping system where it is desirable to maintain the fluid temperature at a design temperature at the outlet from the fluid tube bank to achieve the process or heating objectives.

The most common method for maintaining the fluid temperature in the piping system at the design temperature is to change the flow rate of fuel gas and combustion air to the heater. With a lower flow rate of fuel gas, the heater enclosure will be lower and less heat is transferred from the flame to the fluid tubes.

In many processes, the fluid is sensitive to the rate at which heat is transferred through the fluid film located at the inside wall of the fluid tube. If the fluid film is overheated, thermal degradation or damage to the physical properties of the fluid may occur. Overheating of the fluid film may also cause fouling of the tube walls, which prevents the fluid from effectively convecting heat from the tube wall. As a result, the tube wall temperature may exceed design temperatures for the fluid tube material and eventually result in mechanical failure of the material.

It is, therefore, desirable to have a system and a method for maintaining the desired total heat input and fluid design outlet temperature, without exceeding the design fluid film temperature or a mean temperature of the fluid tube. One way of controlling the fluid design temperature is to control the rate of heat transfer from the heater flame to the outer surfaces of the fluid tubes.

SUMMARY OF THE INVENTION

The present invention is for a system of louvers to block the radiant heat transfer between (1) the flame and hot combustion gases, and (2) a portion of a bank of fluid tubes in a direct-fired heater. The louvers block the heat transfer by mechanically obstructing a direct optical path from the flame and combustion gases to the portion of the bank of fluid tubes. The thermal radiation emitted by the flame and the combustion gases which follows a direct optical path to the fluid tubes will be referred to herein as direct thermal radiation. The louvers do not completely block electromagnetic radiation of all wavelengths, because electromagnetic radiation of certain wavelengths can penetrate any solid material. Also, some of the radiant heat absorbed on a flame-side of the louvers will be conducted to a tube-side of the louvers and will be emitted to directly radiate upon the fluid tubes.

These secondary effects, however, are usually negligible compared to the direct thermal radiation on the fluid tubes. Thus, when adjustable mechanical louvers are positioned to block the direct thermal radiation from reaching the fluid tubes, the amount of direct thermal radiation on the fluid tubes may be controlled by opening and closing the louvers.

It is, therefore, a principal object of the invention to control the amount of direct thermal radiation on the fluid tubes in the heater.

Another object of the invention is to provide a device for controlling the design fluid film temperature tube wall temperature.

Yet another object of the invention is to provide a manually controllable device to adjustably shield a portion of the fluid tubes from radiant heat.

A still further object of the invention is to provide an automatically controllable device to adjustably shield a portion of the fluid tubes from radiant heat.

Still another object of the invention is to provide a device to adjustably shield fluid tubes from direct thermal radiation which device is automatically controllable based on a design fluid film temperature or fluid wall temperature.

Other objects and further scope of the applicability of the present invention will become apparent from the detailed description to follow taken in conjunction with the accompanying drawings.

DETAILED DESCRIPTION OF THE PREFERRED EMBODIMENTS

Figure 1:
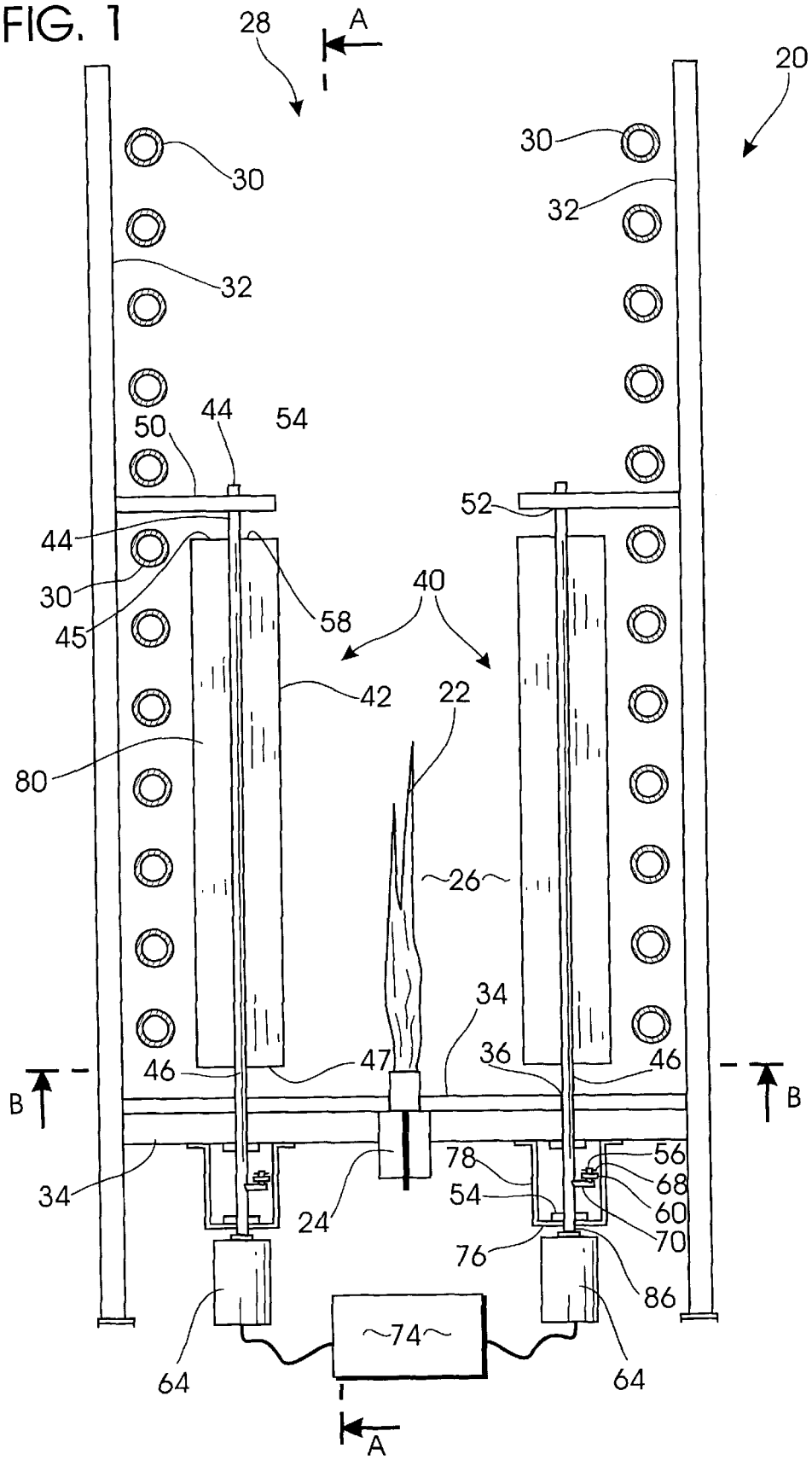
FIG. 1 is a partial, front, elevation, sectional view of a direct-fired heater with a louver system of the present invention.

Like numbers in the drawings indicate like parts in the various embodiments of the present invention.

Figure 2:
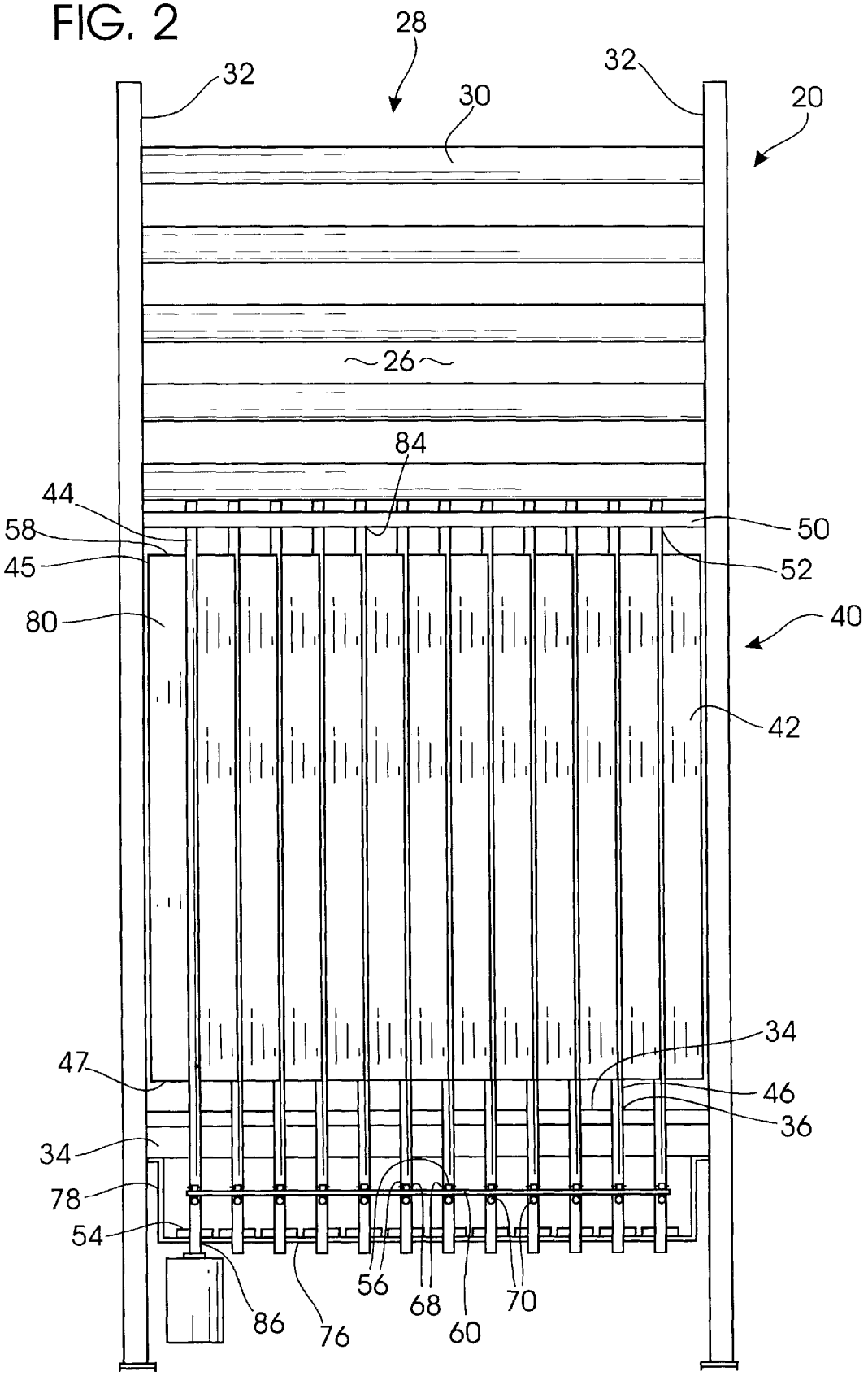
FIG. 2 is a partial side, elevation, sectional view of a direct-fired heater with a louver system of the present invention, taken along section A—A in FIG. 1.
Figure 3:
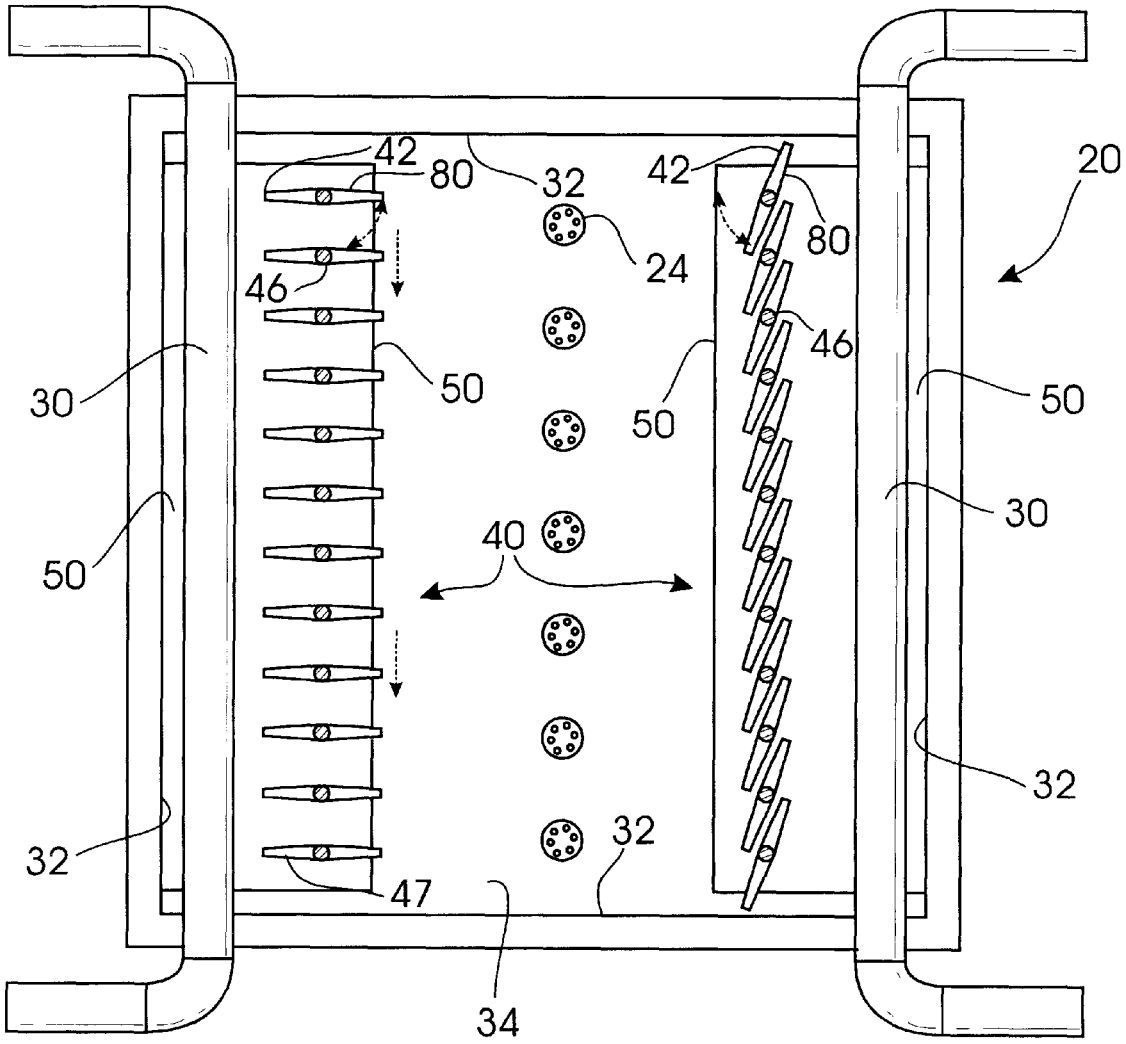
FIG. 3 is a bottom sectional view of a direct-fired heater with a louver system of the present invention, taken along section B—B in FIG. 1.

Referring to the drawings in detail, in FIGS. 1 through 3, a direct-fired heater 20 has a flame 22 produced by a plurality of burners 24. The flame 22 and the hot combustion gases are produced in a central portion 26 of the heater enclosure 28. Fluid tubes 30 are positioned along side walls 32 of the heater 20. Although FIGS. 1–3 show horizontally positioned fluid tubes 30, the fluid tubes 30 may also be vertically positioned. An adjustable louver system 40 is positioned near the fluid tubes 30 on each side of the heater 20. For the particular embodiment shown in FIG. 1, the louver system 40 only provides a shield to direct thermal radiation for the fluid tubes 30 positioned in the lower portion of the heater 20. However, the size of the louver system 40 can be selectively changed to shield from direct thermal radiation as many of the fluid tubes 30 as may be desired.

The louver system 40 has louver blades 42 with a first axle 44 attached to a first end 45 of each louver blade 42 and a second axle 46 attached to a second end 47 of each louver blade 42. For the embodiment shown in FIG. 1, the louver blades 42 are vertically positioned. Each louver blade 42 pivots and rotates about the first axle 44 and the second axle 46 to provide variable amounts of shading between the flame 22 and the fluid tubes 30.

Upper guide plates 50 are attached to and extend from the heater walls 32. The upper guide plates 50 have holes 52 to receive the first axle 44 of each louver blade 42. A collar 54 at the lower end of each second axle 46 supports the weight of each louver blade 42 against a bearing surface 76. The bearing surface 76 is part of a box 78 formed beneath the heater floor 34, where the heater floor 34 is a top of the box 78 and the bearing surface 76 is the bottom of the box 78. Radial arms 70 extend radially outward from a lower end of second axle 46. Each of the radial arms 70 has a pivot pin 56. A connecting plate 60 is a flat plate with slots 62 in the plate for receiving the pivot pins 56. The pivot pins 56 are free to pivot in the slots 62, such that rotation of a first louver blade 80 causes rotation of all of the louver blades 42. The first louver blade 80 is one of the louver blades 42. The second axle 46 of each louver blade 42 fits through heater floor openings 36 and through bearing surface openings 86.

The second axle 46 of the first louver blade 80 is coupled to an electric or pneumatic motor 64 and is called a drive axle 66. The drive axle 66 fits through an opening 36 in the heater floor 34. The motor 64 has a shaft 72 and the motor 64 is controlled by a temperature actuator 74. The motor shaft 72 acts as a drive shaft for the drive axle 66.

The temperature actuator 74 receives a temperature reading from a sensor located inside one of the fluid tubes 30 or on the outside of one of the fluid tubes 30. If the temperature reading indicates the fluid film temperature or the tube outside wall temperature is too hot, the temperature actuator 74 sends a signal to the motor 64 to rotate in a certain direction by a certain number of degrees of rotation, thereby causing the louver blades 42 to close and block more of the direct thermal radiation on the fluid tubes 30. If the temperature reading indicates the fluid film temperature or the tube outside wall temperature is too cold, the temperature actuator 74 sends a signal to the motor 64 to rotate in the opposite direction, thereby causing the louver blades 42 to open to allow more direct thermal radiation to reach the fluid tubes 30. Temperature actuators are well known in the heating art and are not by themselves a subject of the present invention. The temperature actuator 74 is shown schematically in FIG. 1.

Figure 4:
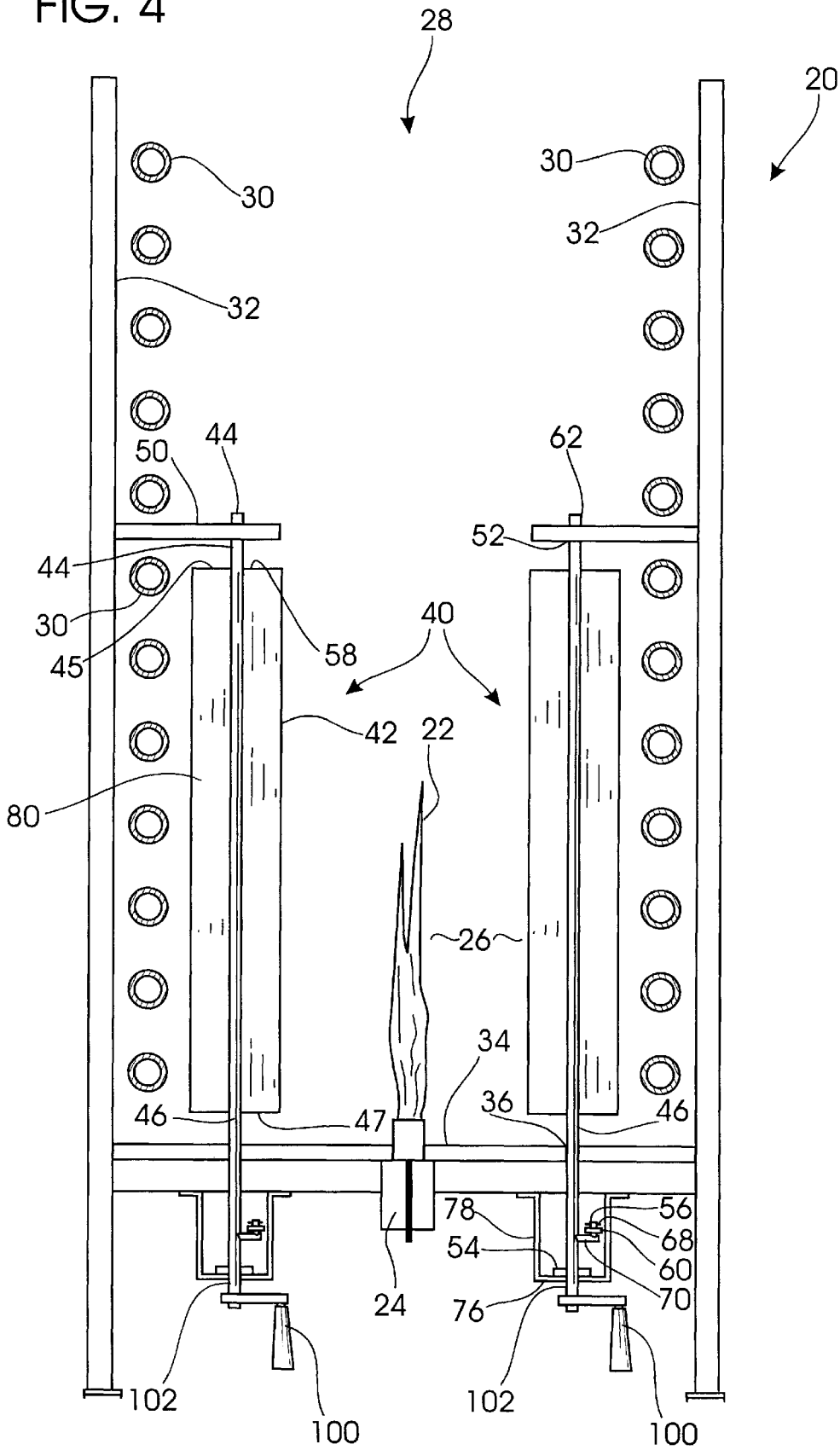
FIG. 4 is a partial side, elevation, sectional view of a direct-fired heater with a louver system of the present invention.

FIG. 4 illustrates an alternate embodiment to the embodiment in FIGS. 1 through 3. A direct-fired heater 20 has a flame 22 produced by burners 24. The flame 22 and the hot combustion gases are produced in a central portion 26 of the heater enclosure 28. Fluid tubes 30 are positioned along side walls 32 of the heater 20. Although FIG. 4 shows horizontally positioned fluid tubes 30, the fluid tubes 30 may also be vertically positioned. An adjustable louver system 40 is positioned near the fluid tubes 30 on each side of the heater 20. For the particular embodiment shown in FIG. 4, the louver system 40 only provides a shield to direct thermal radiation for the fluid tubes 30 positioned in the lower portion of the heater 20. The size of the louver system 40, however, can be selectively changed to shield from direct thermal radiation as many of the fluid tubes 30 as may be desired.

The louver system 40 has louver blades 42 with a first axle 44 attached to a first end 45 of each louver blade 42 and a second axle 46 attached to a second end 47 of each louver blade 42. For the embodiment shown in FIG. 4, the louver blades 42 are vertically positioned. Each louver blade 42 pivots about the first axle 44 and the second axle 46 to provide variable amounts of shading between the flame 22 and the fluid tubes 30.

Upper guide plates 50 are attached to the heater walls 32. The upper guide plates 50 have holes 52 to receive the first axle 44 of each louver blade 42. A collar 54 at the lower end of each second axle 46 supports the weight of each louver blade 42 against a bearing surface 76. The bearing surface 76 is part of a box 78 formed beneath the heater floor 34, where the heater floor 34 is a top of the box 78 and the bearing surface 76 is the bottom of the box 78. Radial arms 70 extend radially outward from a lower end of second axle 46. Each of the radial arms 70 has a pivot pin 56. A connecting plate 60 is a flat plate with slots 62 in the plate for receiving the pivot pins 56. The pivot pins 56 are free to pivot in the slots 62, such that rotation of a first louver blade 80 causes rotation of all of the louver blades 42. The first louver blade 80 is one of the louver blades 42. The second axle 46 of each louver blade 42 fits through heater floor openings 36 and through bearing surface openings 86.

The second axle 46 of the first louver blade 80 is coupled to a hand crank 100 having a crank shaft 102. For this embodiment, the crank shaft 102 acts as a drive shaft. The second axle 46 of the first louver blade 80 is the drive axle 66. Manually turning the hand crank 100 rotates the louver blades 42 to a particular angular position.

Figure 5:
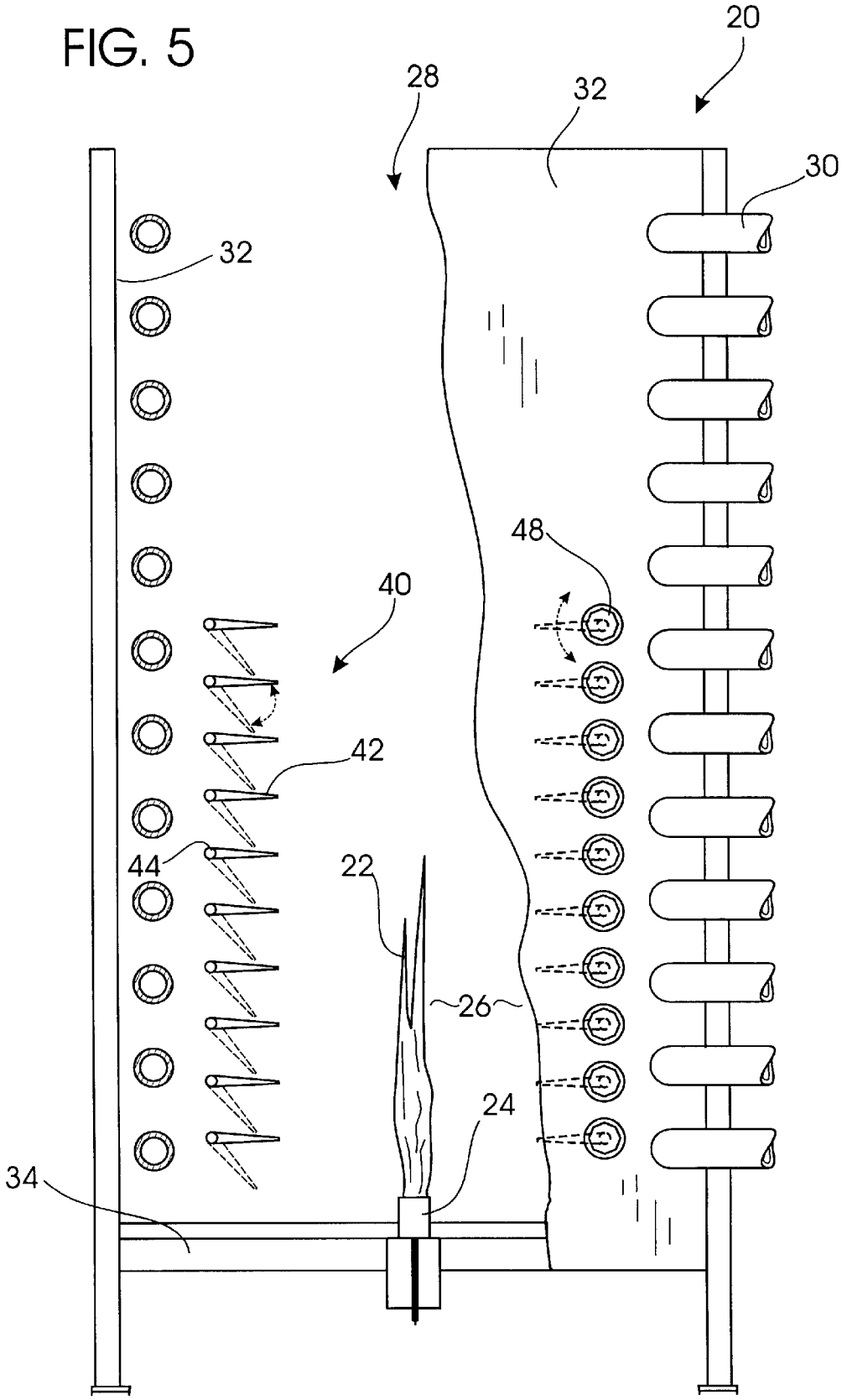
FIG. 5 is a partial, front, elevation, cut-away sectional view of a direct-fired heater with a louver system of the present invention, having horizontally disposed louver blades.
Figure 6:
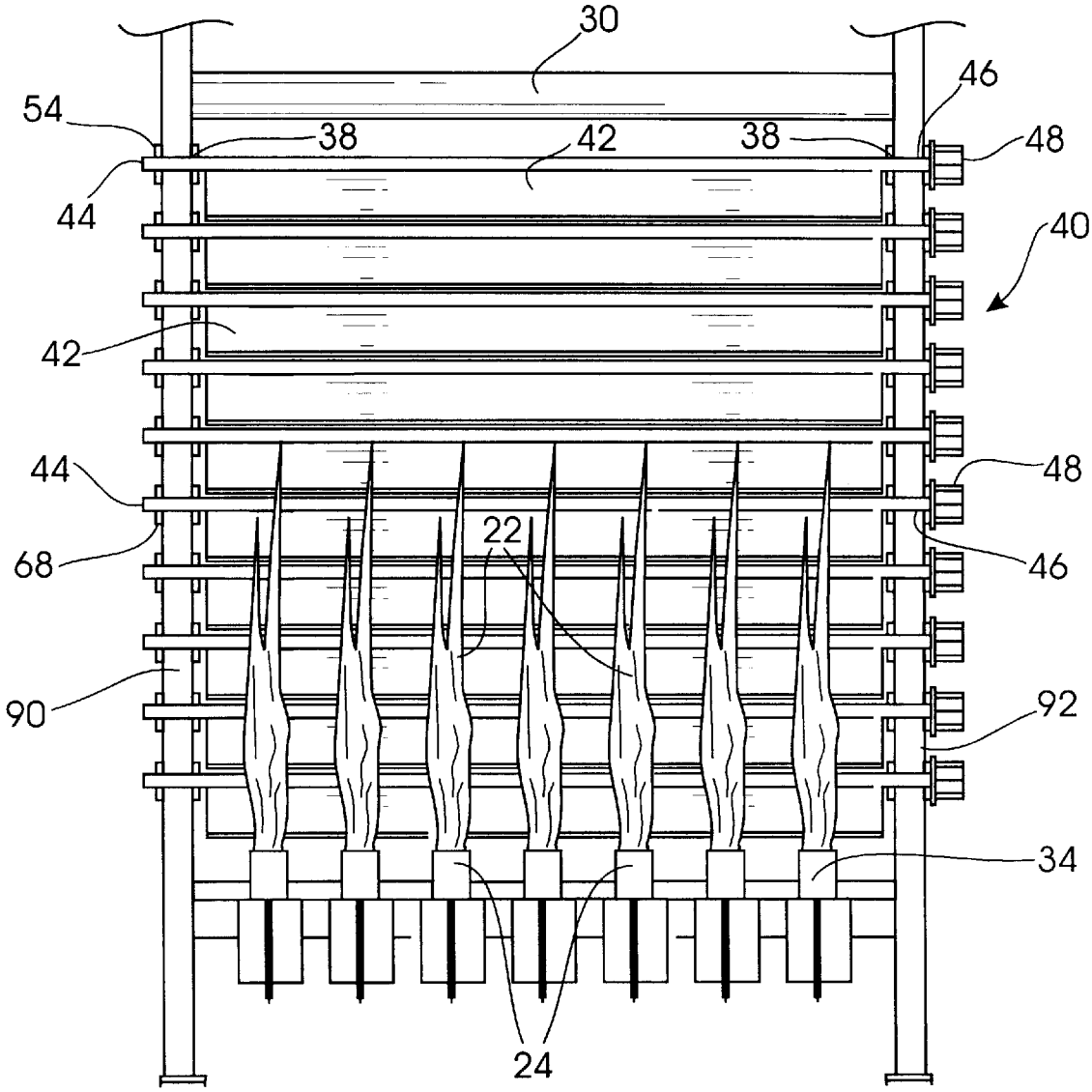
FIG. 6 is a partial, side, elevation view of a direct-fired heater with a louver system of the present invention, having horizontally disposed louver blades.

FIGS. 5 and 6 illustrate a further alternate embodiment. A direct-fired heater 20 has a flame 22 produced by burners 24. The flame 22 and the hot combustion gases are produced in a central portion 26 of the heater enclosure 28. Fluid tubes 30 are positioned along walls 32 of the heater 20. An adjustable louver system 40 is positioned near the fluid tubes 30 on each side of the heater 20. For the particular embodiment shown in FIG. 4, the louver system 40 only provides a shield from direct thermal radiation for the fluid tubes 30 positioned in the lower portion of the heater 20. However, the size of the louver system 40 can be arbitrarily changed to cover as many of the fluid tubes as may be desired.

A manually controlled louver system 40 has horizontally-disposed louver blades 42. Each louver blade 42 pivots about a first axle 44 and a second axle 46. The first axles 44 fit through openings 38 in a first heater wall 90. The second axles 46 fit through openings 39 in a second heater wall 92. A collar 54 on the ends of each axle 44 and 46 restricts horizontal movement of the louver blades 42. A manually controlled knob 48 is attached to the first axle 44, such that turning the knob 48 turns the first axle 44, and in turn rotates the louver blade 42 from open to closed positions, and intermediate positions between the open and the closed positions. The knob 48 is located outside the heater enclosure 28. Collars 54 on the first axle 44 and the second axle 46 of each louver blade 42 prevents lateral movement of the louver blades 42. The rotation of the louver blades 42 provides an optical barrier to direct thermal radiation on the fluid tubes 30.

The present invention has been described in relation to the drawings attached hereto, but it should be understood that other and further modifications, apart from those shown or suggested herein, may be made within the spirit and scope of this invention.

What is claimed is:

1. In a direct-fired heater with a flame and combustion products emitting radiation and fluid tubes, a radiant heat obstruction device positioned between the flame and the fluid tubes, comprising:

a louver system having rotatable louver blades, wherein rotation of said louver blades causes said louver blades to obstruct a variable amount of thermal radiation from the flame and combustion products from directly impinging on the fluid tube.

2. In a direct-fired heater with walls and a floor, with a flame and combustion products emitting radiation, and with fluid tubes, an adjustable louver system for controlling a temperature of fluid film in the fluid tubes, comprising:

(a) an upper guide plate attached to a heater wall, said upper guide plate being opposed to and parallel to the heater floor;

(b) openings in the heater floor;

(c) louver blades extending between said upper guide plate and the heater floor, said louver blades including a first louver blade, each said louver blade including a first end and a second end;

(d) first axles attached to each said first end of each said louver blade;

(e) second axles attached to each said second end of each said louver blade;

(f) said upper guide plate having upper guide plate holes, wherein each said first axle fits into one of said upper guide plate holes;

(g) wherein each said second axle protrudes through one of said heater floor openings and wherein said heater floor openings are aligned with upper guide plate holes;

(h) a collar attached to a portion of said second axle protruding below said heater floor;

(i) a box below the heater floor with a bearing surface, said bearing surface supporting a weight of the louver blades; and (j) louver blade positioning means to rotate each said louver blade, causing said louver blades to obstruct some of the radiation from the flame from directly impinging upon said fluid tubes.

3. The adjustable louver system of claim 2 wherein each said louver blade is parallel to every other said louver blade.

4. The adjustable louver system of claim 2, wherein said louver blade positioning means comprises:

(a) a drive shaft coupled to said second axle of said first louver blade, said drive shaft and said second axle of said first louver blade sharing a common centerline;

(b) radial arms extending from a lower portion of said second axle, said radial arms being positioned in said box;

(c) pivot pins rigidly attached to a top of said radial arms;

(d) a connecting plate with slots therethrough, said pivot pins fitting through said slots to pivotally attach said connecting plate to said top of each said louver blade;

(e) drive means to cause rotation of said drive shaft; and (f) wherein rotation of said drive shaft causes an equal change in an angular position of each said louver blade.

5. The adjustable louver system of claim 4 wherein said drive means comprises a hand crank and said drive shaft is a crank shaft.

6. The adjustable louver system of claim 4 wherein said drive means comprises a motor and said drive shaft is a shaft of said motor.

7. The adjustable louver system of claim 6 wherein said motor is an electric motor.

8. The adjustable louver system of claim 6 wherein said motor is a pneumatic motor.

9. The adjustable louver system of claim 6 wherein actuation of said motor is controllable by a temperature actuator.

10. A louver system for blocking radiative heat transfer from a flame and combustion products to a fluid tube in a direct-fired heater having a first wall and a second wall, the first and second walls being parallel and having aligned openings, comprising:

(a) rotatable louver blades positioned between the flame and the fluid tubes;

(b) a cylindrical first axle rigidly attached to each said louver blade;

(c) a cylindrical second axle rigidly attached to each said louver blade;

(d) said first axle of each louver blade fitting into one of said openings in said first wall;

(e) said second axle of each louver blade fitting into one of said openings in said second wall;

(f) wherein for each louver blade, said first axle and said second axle fit into aligned openings and wherein a part of said first axle extends outside of said first wall and a part of said second axle extends outside of said second wall; and (g) means to rotate each said louver blade to provide an optical barrier between the flame and some of the fluid tubes.

11. The louver system of claim 10 wherein said means to rotate each said louver blade comprises a knob rigidly attached to a part of said first axle which extends outside of said first wall, said knob being manually rotatable.

12. A method for adjustably controlling direct thermal radiation from a flame and combustion products to fluid tubes in a direct-fired heater, comprising:

(a) positioning louver blades of an adjustable louver system between (i) the flame and combustion products; and (ii) the fluid tubes; and (b) rotating the louver blades to adjustably shade the fluid tubes from direct thermal radiation.

13. The method for adjustably controlling radiant heat transfer of claim 12 wherein said rotating step includes:

(a) coupling a first axle of a first louver blade to a shaft of a motor;

(b) pivotally connecting pivot pins on top of radial arms to a connecting plate, said radial arms extending from a second axle of said louver blades; and (c) rotating said shaft of said motor.

14. The method of adjustably controlling radiant heat transfer of claim 13 wherein said motor is an electric motor.

15. The method of adjustably controlling radiant heat transfer of claim 13 wherein said motor is a pneumatic motor.

16. The method of adjustably controlling radiant heat transfer of claim 13 wherein said rotating step is controlled by a temperature actuator.

* * * * *